United States Patent [19]

Wagener

[11] Patent Number: 4,602,496

[45] Date of Patent: Jul. 29, 1986

[54] REFORMING TOOL FOR A HOSE FITTING

[76] Inventor: J. Parry Wagener, 180 Requa Rd., Piedmont, Calif. 94611

[21] Appl. No.: 660,226

[22] Filed: Oct. 12, 1984

[51] Int. Cl.[4] ..... B21D 9/08; B21D 41/00

[52] U.S. Cl. ..... 72/409; 72/370; 81/302

[58] Field of Search ..... 72/409, 370, 392; 81/302, 3.5, 3.6; 29/239, 242, 283.5, 270, 278; 7/157, 114

[56] References Cited

U.S. PATENT DOCUMENTS

| | | | |
|---|---|---|---|
| 1,093,400 | 4/1914 | Gottfried | 81/418 |
| 1,219,160 | 3/1917 | Rosenblatt | 81/302 |
| 1,399,665 | 12/1921 | Shapiro | 72/392 |
| 1,880,172 | 9/1932 | Bergman et al. | 72/409 |
| 2,334,781 | 11/1943 | Maines | 81/302 |
| 2,503,657 | 4/1950 | Craig | 72/392 |
| 2,618,184 | 11/1952 | Goedhart | 72/409 |
| 2,650,735 | 9/1953 | Redmond | 81/302 |
| 2,784,623 | 3/1957 | Reynolds | 72/409 |
| 3,233,313 | 2/1966 | Roth | 81/302 |
| 4,474,046 | 10/1984 | Cook | 72/409 |

*Primary Examiner*—Daniel C. Crane

*Attorney, Agent, or Firm*—Manfred M. Warren; Robert B. Chickering; Glen R. Grunewald

[57] ABSTRACT

A tool for reforming a male, externally threaded, gardenhose fitting is disclosed. The plier-like tool includes pivoted lever arms which carry transversely extending swaging lobes that can be inserted inside a deformed hose fitting. The lobes are notched to receive an inwardly extending annular end flange commonly present on such fittings, and expansion of the lobes and relative rotation of the fitting and the lobes swages and reforms, not only the length of the fitting, but the end flange. The tool also includes recesses that can be used to initially open the fitting and to finish-up the reforming process.

1 Claim, 6 Drawing Figures

FIG _ 1
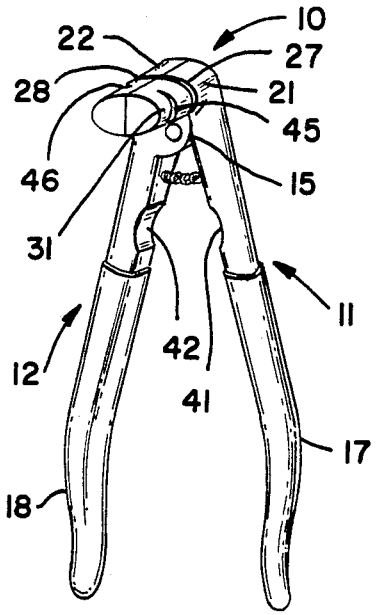
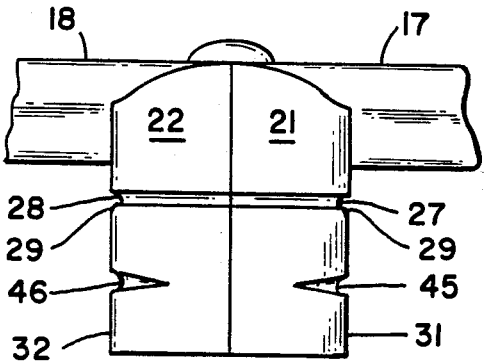
FIG _ 2
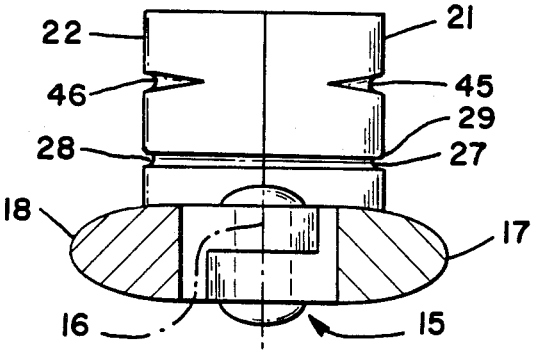
FIG _ 3
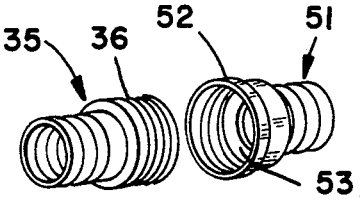
FIG _ 6
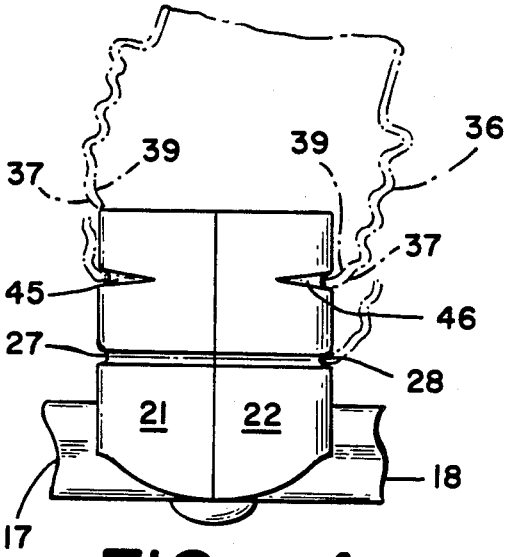
FIG _ 4
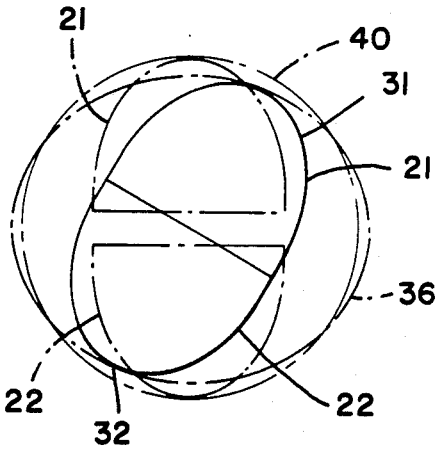
FIG _ 5

REFORMING TOOL FOR A HOSE FITTING

BACKGROUND OF THE INVENTION

This invention relates to hand tools adapted for specialized tasks, and more particularly to a tool for reforming a deformed, externally threaded, tubular hose fitting.

One type of universally used coupling for joining a pair of hoses, a hand-held sprinkler nozzle or other accessories to a hose comprises a relatively thin-walled brass, male fitting having an externally threaded tubular end portion that is matingly threaded into a female, internally threaded, companion member. When threaded together, the circular end flange of the male fitting is urged against a rubber washer or gasket carried by the female fitting, thus sealing the parts together. The male fitting is customarily mounted in telescopic relation to a length of garden hose end, and the female fitting is provided on a second length of hose or a sprinkler nozzle. It is quite common, however for the hose with the male end to be laying upon the ground unattached to its female counterpart, where it is subject to being stepped on or run over by an automobile or a piece of gardening equipment. The result is often a premature flattening of the male fitting to a deformed form which may no longer be threaded onto its companion connecting member to provide the desired sealed connection. Such deformation of the male fitting is due to the thin-wall and malleability of the metal used in the manufacture of the fitting and is much more common than deformation of the relatively heavy walled female fitting.

Prior to the advent of the tool of the present invention attempts to reform such a deformed male garden hose fitting to reusable form have been largely unsatisfactory. Crude attempts with standard household tools have resulted in fittings which do not mate properly and which leak water at the coupling. Such leaking can be the result of an inability to restore the threaded end to a circular configuration and/or an inability to reform the end flange of the fitting to a smooth annular surface that will mate with the sealing gasket typically carried by the female fitting. In either event the result is particularly aggravating. When the deformed hose end is coupled to a hand-held sprinkler nozzle, for example, the water pressure will cause the leak to spray the user with water. Accordingly, as a result of such fitting deformation, the fitting usually must be cut off from the hose and replaced by a new fitting in order to repair the leak.

Although hand tools for the purpose of reforming hose fittings are not known, hand tools for other specialized applications are known in the art. Related devices are disclosed in the following patents:

Maines, U.S. Pat. No. 2,334,781;
Redmond, U.S. Pat. No. 2,650,735;
Roth, U.S. Pat. No. 3,233,313; and
Rosenblatt, U.S. Pat. No. 1,219,160.

Maines discloses an expansion jaw pliers adapted for biting against the inner surface of an object to facilitate its application or removal. Redmond discloses a tool for installing insulated conduit collets having spaced-apart projections that are bent backward to hold the collet in position.

The patent to Roth discloses a tool for expanding a flexible tube for applying the tube to another tube. Finally, the patent to Rosenblatt discloses a hand tool for stretching shell rims of eye glasses in order to expand their diameter to mount them upon lenses. None of the foregoing tools is adapted for permanently changing the diameter of a tubular metal object, such as a hose fitting, in order to reform an object which has been accidentally deformed and rendered nonfunctional.

SUMMARY OF THE INVENTION

In accordance with the foregoing background discussion, it is an object of the present invention to provide a hand tool specially designed for reforming deformed hose fittings, thereby making the fittings functional again.

It is another object of this invention to provide a hand tool that reforms a deformed hose fitting to its original circular form, without damage to the threads of the fitting.

Still a further object of the present invention is to provide a hand tool that is capable of reforming the end flange of a deformed, male hose fitting so that it will seat in sealed relation to a sealing washer in a female fitting.

It is also a object of this invention to provide a reforming tool for a hose fitting with a deformed, externally threaded tubular portion that is durable, simple to use and economical to manufacture.

With the foregoing and other objects in view, a reforming tool for a hose fitting in accordance with certain features of the invention includes two lever arms having a pivotal connection therebetween, manually engageable handles extending from one side of the pivotal connection and swaging lobes positioned at the opposite side of the pivotal connection and oriented generally parallel to the pivotal connection with lengths at least equal to the axial dimension of the deformed portion of the hose fitting.

The swaging lobes are formed with grooves, so that upon insertion of the lobes into the deformed portion of the hose fitting, the grooves receive an inwardly extending end flange of the fitting, and the handles may be squeezed and the lobes expanded to a diameter concentric to the circular form desired. Upon relative rotation of the deformed portion of the hose fitting on the lobes and squeezing of the tool handles, the simultaneous swaging of the deformed threaded portion and swaging of the flange results in reformation of both the cylindrical fitting end and the sealing flange to their original, circular forms for reuse with its connecting member.

This and other objects, features and advantages of the present invention will be apparent from the following detailed description and drawings.

BRIEF DESCRIPTION OF THE DRAWINGS

FIG. 1 is a perspective view of the reforming tool of the present invention;

FIG. 2 is a fragmentary top view of the tool on a somewhat enlarged scale;

FIG. 3 is a fragmentary bottom view of the tool;

FIG. 4 is a view similar to FIG. 2 showing the tool being inserted into the tubular portion of a hose fitting;

FIG. 5 is a front view of a portion of the tool showing the application of the tool in effecting reformation of the fitting; and FIG. 6 is a perspective view of the male and female fittings comprising a typical coupling used between hose lengths.

DETAILED DESCRIPTION OF THE INVENTION

Referring now more particularly to the drawings, the reforming tool 10 of the present invention is designed for reforming a male hose fitting 35 having a deformed externally threaded tubular portion 36 which terminates in an internally extending end or sealing flange 37 adapted to seat on a sealing gasket 53 carried by internally threaded nut portion 52 of a female connecting member 51 (FIG. 6). Reforming tool 10 includes a pair of lever arms 11 and 12 secured by a pivotal connection 15 to provide manually engageable handle lengths 17 and 18 extending from one side of the pivot axis 16 of connection 15. Positioned on the lever arms at the opposite side of pivotal connection 15 are swaging lobes 21 and 22. Lobes 21 and 22 have lengths substantially parallel to axis 16 and at least about equal to the axial dimension of threaded, deformed portion 36, of the hose fitting which is to be reformed for continued use.

The substantially parallel relationship of swaging lobes 21 and 22 to pivotal axis 16 insures that convex lobe surfaces 31 and 32 move outwardly in generally parallel relation so that the entire length of fitting end 36 is outwardly reformed to a substantially cylindrical shape. As will be seen from the drawing, lobes 21 and 22 are preferably formed with parallel outer surfaces 31 and 32.

It should be noted that levers 11 and 12 should be formed to enable displacement of lobes 21 and 22 beyond a true cylinder to accommodate material resiliency which will cause portion 36 and end 37 to contract back inwardly once pressure from the tool is released.

While swaging lobes 21 and 22 can be used to bring a deformed end portion 36 back to a substantially cylindrical shape, it is a further important feature of the present invention that tool 10 can be used to reform deformations in inwardly extending annular flange 37. Flange 37 provides a surface (usually a spherical surface) which will seal against a washer or sealing gasket 53 in female fitting 51. If there are significant indentations or irregularities in flange 37, it will not seal with washer 53 even though threaded portion 36 is cylindrical and substantially mates with the internal threads of fitting 51.

In order to reform flange 37, therefore, it is preferable to provide the inner end of swaging lobes 21 and 22 with grooves 27 and 28 dimensioned to receive flange 37. Grooves 27 and 28 preferably further have rounded shoulders 29 that mate with the inner surface 39 of flange 37. Grooves 27 and 28 are positioned in a common plane transverse to axis 16 so as to separate along such common plane upon squeezing motion of handles 17 and 18 by the user.

As best may be seen in FIG. 5, the swaging lobes may be inserted into the fitting until flange 37 resides in notches 27 and 28. The lobes are inserted in the closed, solid line position shown in FIG. 5 with the oval cross-sectional shape of the combined lobes generally aligned with the oval shape of the deformed fitting 36, shown in phantom. Squeezing of handles 17 and 18 of the tool by the user results in expansion separation of the lobes, and relative rotation of the tool and the fitting during such lobe expansion reforms the fitting back toward the phantom line circular cross-section shown at 40.

Additionally, lobes 21 and 22 have convex surfaces 31 and 32 substantially equal to the length of deformed threaded portion 36. Thus, expansion of the lobes simultaneously reforms or irons-out irregularities not only flange 37 but the entire threaded portion 36.

The surfaces of lobes 21 and 22 preferably have a length dimension parallel to axis 15 at least about equal to the length of nozzle portion 36 and are oval-shaped to provide a caming action upon relative rotation of portion 36 and the swaging lobes. The caming action and the small contact area between lobes 21 and 22 and the fitting during rotation makes it relatively easy for even users having modest strength to reform the fitting back to its original circular shape.

In a further embodiment of the invention, lever arms 11 and 12 are provided with opposed recesses 41 and 42, formed and positioned for external engagement with and displacement of portion 36 to approximate the desired circular form. It is not uncommon for fitting 35 to be deformed to such a degree that lobes 21 and 22 cannot be inserted into the fitting. In order to assist in returning the fitting to its original shape, cylindrical recesses 41 and 42 on the handle side of pivotal connection 15 may be used to squeeze the outside of the fitting. Once the opening in the fitting end is large enough, lobes 21 and 22 can be inserted and the fitting reformed from within by the two lobes. Recesses 41 and 42 also can be used, with swaging from within by lobes 21 and 22, to provide final finishing or final truing-up of the cylindrical end portion 36.

Since it is desirable in order to minimize the length of travel of handles 17 and 18 that lobes 21 and 22 have a combined diameter which is reasonably closed to the circular diameter of the fitting opening defined by flange 37, it is further preferable to provide lobes 21 and 22 with intermediate notches 45 and 46. As best may be seen in FIG. 4, notches 45 and 46 can be used to walk the fitting on or off the lobes by alternatively rocking the tool and/or fitting to move flange 37 from notches 27 and 28 to notches 45 and 46 and off the end of the lobes. Usually inserting the lobes into the deformed end 36 of the fitting is not a problem which requires rocking of the tool, but once the end is reformed, it will have a diameter which closely approximates the combined lobe diameter in the closed positin, but flange 37 will interfere with or inhibit easy withdrawal of the tool. Rocking of the fitting into notches 45 and 46 will, therefore, enable easy removal of the lobes.

What is claimed is:

1. In a reforming tool for reforming a deformed hose fitting to its original cylindrical shape including a pair of lever arms each formed with a manually engageable handle at one end and a swaging lobe at an opposite end, and pivotal connection means joining said lever arms together at a pivotal axis intermediate the handles and the lobes for pivotal movement of said lobes from an abutting position along an arcuate path away from each other to a separated position upon pivotal movement of said handles from a separated position toward each other, wherein the improvement in said reforming tool comprises:

said lobes being formed to provide oppositely facing convex swaging surfaces extending substantially parallel to said pivotal axis away from a common side of said lever arms for the application of a rotational torque about said lobes by said lever arms;

said lobes in said abutting position having a combined oval-shaped transverse cross section in a plane perpendicular to said pivotal axis taken through a swaging area of said surfaces, said oval-shaped transverse cross section in said swaging area having a minor axis oriented substantially on a plane passing through said pivotal axis and a major axis oriented substantially perpendicular to said minor axis, said swaging surfaces being provided proximate said major axis and aligned with said arcuate path for movement apart along said arcuate path upon movement of said handles toward each other;

said oval-shaped transverse cross section in said swaging area being substantially symmetrical about both said major axis and said minor axis to provide a camming action upon rotation of said lobes in either of opposite directions;

said swaging surfaces each having a radius of curvature in said swaging area proximate said major axis less than one half the combined distance along said major axis between said swaging surfaces when said lobes are in said abutting position; and said lobes further being formed with an arcuate groove symmetrical about said major axis in said swaging surfaces in a common plane perpendicular to said pivotal axis and at a spaced distance toward said lever arms from the distal ends of said lobes and inwardly of said swaging area.

* * * * *